US005720873A

United States Patent [19]

Klingberg et al.

[11] Patent Number: 5,720,873

[45] Date of Patent: Feb. 24, 1998

[54] METHOD OF FLOATING CALCIUM CARBONATE ORE AND FLOTATION REAGENT THEREFOR

[75] Inventors: Anders Klingberg, Henån; Lisbeth Olsson, Jörlanda, both of Sweden

[73] Assignee: Akzo Nobel NV, Arnhem, Netherlands

[21] Appl. No.: 549,852

[22] PCT Filed: Apr. 27, 1994

[86] PCT No.: PCT/SE94/00376

§ 371 Date: Mar. 1, 1996

§ 102(e) Date: Mar. 1, 1996

[87] PCT Pub. No.: WO94/26419

PCT Pub. Date: Nov. 24, 1994

[30] Foreign Application Priority Data

May 19, 1993 [SE] Sweden ..... 9301717-6

[51] Int. Cl.[6] ..... B03D 1/02; B03D 1/01

[52] U.S. Cl. ..... 209/166; 209/167; 252/61; 252/357

[58] Field of Search ..... 209/166, 167; 252/61, 357

[56] References Cited

U.S. PATENT DOCUMENTS

| | | | |
|---|---|---|---|
| 3,088,796 | 5/1963 | Kahler . | |
| 3,444,090 | 5/1969 | Brookfield . | |
| 3,975,295 | 8/1976 | Koch . | |
| 4,737,273 | 4/1988 | Snow . | |
| 4,995,965 | 2/1991 | Mehaffey et al. | 209/166 |
| 5,084,254 | 1/1992 | Golley . | |
| 5,124,028 | 6/1992 | Klimpel . | |
| 5,261,539 | 11/1993 | Hancock et al. | 209/166 |

FOREIGN PATENT DOCUMENTS

| | | |
|---|---|---|
| 203943 | 1/1956 | Australia . |
| 1100239 | 4/1981 | Canada . |
| 1 187 212 | 5/1985 | Canada . |
| 2 240 296 | 7/1975 | France . |
| 1411043 | 7/1988 | U.S.S.R. . |
| 1 056 962 | 2/1967 | United Kingdom . |

OTHER PUBLICATIONS

Derwents abstracts, No. C90–098166/13.

International Search Report, dated Aug. 26, 1994.

*Primary Examiner*—Thomas M. Lithgow

*Attorney, Agent, or Firm*—Ralph J. Mancini; Louis A. Morris

[57] ABSTRACT

The invention relates to a method of floating calcium carbonate ore containing silicates as impurities. Floatation is performed in the presence of a quaternary ammonium compound and an alkylene oxide adduct of an amine compound. The silicate being concentrated in the float.

12 Claims, No Drawings

METHOD OF FLOATING CALCIUM CARBONATE ORE AND FLOTATION REAGENT THEREFOR

The present invention relates to a method of floating calcium carbonate ore containing silicates as impurities. According to the invention, flotation is performed in the presence of a quaternary ammonium compound and an alkylene oxide adduct of an amine compound, the silicate being concentrated in the float.

From U.S. Pat. No. 4,995,965 it is known to separate calcium carbonate from impurities, such as silicate, by the steps of floating the silicate and concentrating the valuable mineral, i.e. the calcium carbonate in the remainder, in the presence of amine-group containing collectors. From this patent specification appears that a number of cationic compounds, such as methyl-bis(2-hydroxypropyl)-cocoalkyl ammonium methyl sulphate, dimethyl didecyl ammonium chloride, dimethyl-di(2-ethylhexyl)-ammonium chloride, dimethyl-(2-ethyl-hexyl)-cocoalkyl ammonium chloride, dicocoalkyl dimethvi ammonium chloride, and n-tallow alkyl-1,3-diamino propane diacetate can be used as collectors in such a flotation procedure. The patent specification also states that quaternary ammonium compounds, as represented by Arquad 2C (dimethyl dicocoalkyl ammonium chloride) and a combination of Duomac T (N-tallow alkyl-1,3-diamino propane diacetate) and Ethomeen 18/16 (long-chain alkylamine+50 EO) can be used as collectors, although they yield an unacceptably high content of acid-insoluble matter in the valuable mineral.

It has now surprisingly been found that when cleaning calcium carbonate containing silicates as impurity, a very high yield and/or high selectivity (low content of acid-insoluble matter) can be achieved if reverse flotation is performed in the presence of a quaternary ammonium compound in combination with an alkylene oxide adduct of an amine compound. More specifically, the present invention relates to a froth-flotation process performed in the presence of a quaternary ammonium compound having the formula

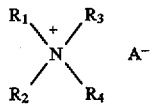

(I)

wherein one or two of the groups $R_1$, $R_2$, $R_3$ and $R_4$ are a hydrocarbon group having 8–36 carbon atoms and the remaining groups a hydrocarbon group having 1–7 carbon atoms or a hydroxyalkyl group having 2–7 carbon atoms, and A is an anionic counterion, and an alkylene oxide adduct having the formula

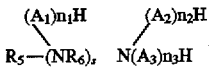

(II)

wherein $R_5$ is a hydrocarbon group having 8–22 carbon atoms, $A_1$, $A_2$ and $A_3$ are an alkylene oxide group having 2–4 carbon atoms, $R_6$ is an alkylene group having 2–3 carbon atoms, $n_1$, $n_2$ and $n_3$ are 3–20 and the sum of all $n_1$, $n_2$ and $n_3$ is 10–40, and s is 0–3; the weight ratio of the quaternary ammonium compound to the alkylene oxide adduct being 3:2–11:1, preferably 7:3–9:1, and calcium carbonate being recovered from the remainder while contaminating silicates are removed with the float. By the method of the invention, it has now been found possible to significantly reduce the content of insoluble silicates, such as quartz, feldspar, amphibole and pyroxene. In formula (I), two of the groups $R_1$, $R_2$, $R_3$ and $R_4$ preferably consist of straight or chained, saturated or unsaturated alkyl groups having 8–22 preferably 10–16 carbon atoms, while the two remaining groups preferably are alkyl groups having 1–3 carbon atoms or hydroxyalkyl groups having 2–3 carbon atoms. A generally is a monovalent ion, such as methyl sulphate or chloride. Specific examples of compounds of formula (I) are dimethyl didecyl ammonium chloride, dimethyl dicycloalkyl ammonium chloride, dimethyl dilauryl ammonium chloride, dimethyl distearyl ammonium chloride, dimethyl ditallow alkyl ammonium chloride and corresponding methyl sulphate salts. Alkylene oxide adducts of formula (II) preferably are such where $R_5$ is a straight or branched, saturated or unsaturated alkyl group having 10–20 carbon atoms and the sum of all $n_1$, $n_2$ and $n_3$ is 12–30. Of all the alkyleneoxy groups in the alkylene oxide adduct, 70–100% preferably are ethyleneoxy groups and 0–30% propyleneoxy groups. For reasons of production technique, such compounds are generally preferred where all alkyleneoxy groups are ethyleneoxy groups. The symbol s preferably is 0 or 1. By suitably varying the number of alkyleneoxy groups, their type and the number of carbon atoms in the hydrophobic moiety R, the compounds of formula (II) can easily be given such properties that they can be mixed with the compounds of formula (I) to form stable mixtures. Moreover, the quaternary ammonium compounds of formula (I) are generally prepared in the presence of an alcoholic solvent, such as isopropanol, in a content of about 10–15% by weight of the ammonium compound. The action of such a solvent usually yields, upon admixture with compounds (I) and (II), a clear, homogeneous and stable liquid phase.

The collectors according to the present invention can be added separately, but are preferably added together as a single flotation reagent. The total content of the two compounds may vary within wide limits but generally amounts to 50–2000 preferably 200–1000 g/tonne of ore to be floated.

In the application of the present invention, it is possible, in addition to the additives mentioned above, to add other additives which are well-known in float flotation. Examples of such additives are pH-adjusting agents, such as sodium carbonate and sodium hydroxide; depressants, such as starch, quebracho, tannin, dextrin and guar gum, and polyelectrolytes, such as polyphosphate and water glass, which have a dispersant effect, often combined with a depressant effect. Other conventional additives are foaming agents, such as methylisobutylcarbinol, triethoxybutane and polypropylene oxide and its alkyl ethers.

The method of the invention is further illustrated by the following Example.

EXAMPLE 1

Calcite ore containing 1.6% by weight of silicate mineral (quartz, feldspar, amphibole, pyroxene) was ground in an amount of 0.5 kg together with 0.5 kg of water to a particle size of −250 μm. The ground material was transferred to a 1.5-liter flotation cell. After dilution with water to 1.4 l, 56% of the collector reagent used was added in the form of a 0.5% aqueous solution. After conditioning for three minutes, the float was withdrawn during 1.5 min. Another 22% of the reagent was thereafter added to the remainder, which was conditioned for three minutes, whereupon the whole mixture was floated for 1.5 min. To the remainder was charged another 22% of the reaction mixture, and the whole mixture was conditioned for 3 min and thereafter floated. The resulting flotation remainder was dried, weighed and analysed for content acid-insoluble in 25% hydrochloric acid. The collectors used and the results obtained appear from the following tables.

TABLE 1

| Collector | Designation |
|---|---|
| Dimethyl dicocoalkyl ammonium chloride | I a |
| N-tallow alkyl-1,3-diamine propane di-acetate | I b |
| Monotallow alkylamine + 15 EO | II a |
| Monotallow alkylamine + 50 EO | II b |
| Monococoalkylamine + 5 EO | III a |
| Monococoalkylamine + 11 EO | III b |
| Monococoalkylamine + 17 EO | III c |
| Monotallow alkyldiaminopropane + 10 EO | IV a |
| Monotallow alkyldiaminopropane + 20 EO | IV b |
| Monotallow alkyldiaminopropane + 30 EO | IV c |
| Monotallow alkyldiaminopropane + 40 EO | IV d |

TABLE 2

| | Collector 1 | | Collector 2 | | Acid insoluble matter | Calcite yield |
|---|---|---|---|---|---|---|
| Test | Type | g/tonne | Type | g/tonne | % | % |
| A | I a | 350 | — | — | 0.32 | 97.5 |
| B | I b | 87.5 | II b | 262.7 | 0.24 | 87.8 |
| C | I b | 175 | II b | 175 | 0.18 | 94.1 |
| D | I b | 262.7 | II b | 87.5 | 0.12 | 84.2 |
| E | — | — | II b | 350 | 1.34 | 96.9 |
| F | I a | 175 | II b | 175 | 0.47 | 97.7 |
| G | I a | 245 | II b | 105 | 0.30 | 98.0 |
| H | I a | 280 | II b | 70 | 0.20 | 97.8 |
| I | I a | 450 | — | — | 0.15 | 96.8 |
| 1 | I a | 360 | II a | 90 | 0.09 | 98.2[1)] |
| 2 | I a | 360 | III a | 90 | 0.08 | 97.4[1)] |
| 3 | I a | 360 | III b | 90 | 0.06 | 97.8[1)] |
| 4 | I a | 360 | III c | 90 | 0.06 | 97.7[1)] |
| 5 | I a | 360 | IV a | 90 | 0.12 | 98.0[1)] |
| 6 | I a | 360 | IV b | 90 | 0.08 | 98.4[1)] |
| 7 | I a | 360 | IV c | 90 | 0.06 | 98.2[1)] |
| 8 | I a | 360 | IV d | 90 | 0.03 | 97.6[1)] |

In tests 1–8, the calcite yield is calculated at 0.20% acid-insoluble matter.

From these results appears that the flotation tests according to the invention, i.e. tests 1–8, gave a considerably lower content of acid-insoluble matter and, at the same content of acid-insoluble matter, a higher calcite yield than the prior-art technique and reference samples.

We claim:

1. A method of cleaning calcium carbonate ore containing silicate impurities which comprises subjecting said ore to a froth-flotation process in the presence of a cationic collector, wherein the collector is a combination of a quaternary ammonium compound having the formula

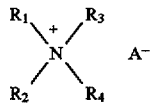

(I)

wherein one or two of the group $R_1$, $R_2$, $R_3$ and $R_4$ are selected from a hydrocarbon group having 8–36 carbon atoms and the remaining groups are selected from a hydrocarbon group having 1–7 carbon atoms or a hydroxyalkyl group having 2–7 carbon atoms and A is an anionic counterion and an alkylene oxide adduct having the formula

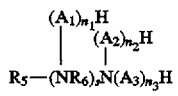

(II)

wherein $R_5$ is a hydrocarbon group having 8–22 carbon atoms, $A_1$, $A_2$ and $A_3$ are alkylene oxide groups having 2–4 carbon atoms, $R_6$ is an alkylene group having 2–3 carbon atoms, $n_1$, $n_2$ and $n_3$ are 3–20 and the sum of all of $n_1$, $n_2$ and $n_3$ is 10–40, and s is 0–3, wherein the weight ratio of the quaternary ammonium compound to the alkylene oxide adduct is 3:2–11:1 and recovering the calcium carbonate from the remainder, while removing the contaminating silicates with the float.

2. The method of claim 1 wherein two of the groups $R_1$, $R_2$, $R_3$ and $R_4$ are selected from hydrocarbon groups having 8–22 carbon atoms, while the two remaining groups are alkyl groups having 1–3 carbon atoms or hydroxyalkyl groups having 2–3 carbon atoms.

3. The method of claim 2 wherein the quaternary ammonium compound is a dimethyl dicocoalkyl ammonium salt.

4. The method of claim 1 wherein $R_5$ is an alkyl group having 10–20 carbon atoms and that the sum of $n_1$, $n_2$ and $n_3$ is 12–30.

5. The method of claim 1 wherein 70–100% of all alkyleneoxy groups in the alkylene oxide adduct are ethyleneoxy groups and 0–30% propyleneoxy groups.

6. The method of claim 1 wherein s is 0 or 1.

7. A flotation reagent which comprises a quaternary ammonium compound having the formula

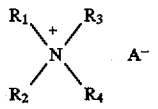

(I)

wherein two of the groups $R_1$, $R_2$, $R_3$ and $R_4$ are selected from hydrocarbon groups having 8–36 carbon atoms and the remaining groups are selected from hydrocarbon groups having 1–7 carbon atoms or hydroxyalkyl groups having 2–7 carbon atoms, and A is an anionic counterion, in combination with an alkylene oxide adduct having the formula

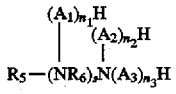

(II)

wherein $R_5$ is a hydrocarbon group having 8–22 carbon atoms, $A_1$, $A_2$ and $A_3$ are alkylene oxide groups having 2–4 carbon atoms, $R_6$ is an alkylene group having 2–3 carbon atoms, $n_1$, $n_2$ and $n_3$ are 3–20 wherein the sum of $n_1$, $b_2$ and $n_3$ is 10–40, and s is 0–3, wherein the weight ratio of the quaternary ammonium compound to the alkylene oxide adduct is 3:2–11:1.

8. The flotation reagent of claim 7 wherein two of the groups $R_1$, $R_2$, $R_3$ and $R_4$ are hydrocarbon groups having 8–22 carbon atoms and the two remaining groups are selected from alkyl groups having 1–3 carbon atoms or hydroxyalkyl groups having 2–3 carbon atoms.

9. The flotation reagent of claim 7 wherein $R_5$ is an alkyl group having 10–20 carbon atoms and that sum of $n_1$, $n_2$ and $n_3$ is 12–30.

10. The flotation reagent of claim 7 wherein 70–100% of all alkyleneoxy groups in the alkylene oxide adduct are ethyleneoxy groups and 0–30% are propyleneoxy groups.

11. The flotation reagent of claim 8 wherein two of the groups $R_1$, $R_2$, $R_3$ and $R_4$ are hydrocarbon groups having 10–16 carbon atoms.

12. The method of claim 2 wherein two of the groups $R_1$, $R_2$, $R_3$ and $R_4$ are hydrocarbon groups having 10–16 carbon atoms.

* * * * *